US005590392A

United States Patent [19]

Ishiwata et al.

[11] Patent Number: 5,590,392

[45] Date of Patent: Dec. 31, 1996

[54] CORROSION-RESISTANT MATERIAL FOR CONTACT WITH HIGH TEMPERATURE MOLTEN METAL AND METHOD FOR PRODUCTION THEREOF

[75] Inventors: Yutaka Ishiwata, Zushi; Yoshiyasu Itoh, Yokohama, both of Japan

[73] Assignee: Kabushiki Kaisha Toshiba, Kanagawa-ken, Japan

[21] Appl. No.: 393,309

[22] Filed: Feb. 22, 1995

[30] Foreign Application Priority Data

Feb. 24, 1994 [JP] Japan ..... 6-026769

[51] Int. Cl.[6] ..... B22F 1/00

[52] U.S. Cl. ..... 428/546; 428/551; 428/552; 75/228; 75/230; 75/232

[58] Field of Search ..... 428/546, 551, 428/552; 75/228, 230, 232

[56] References Cited

U.S. PATENT DOCUMENTS

| | | | |
|---|---|---|---|
| 3,969,278 | 7/1976 | Aksenov et al. | 252/513 |
| 4,861,641 | 8/1989 | Foster et al. | 428/137 |
| 4,999,336 | 3/1991 | Nadkarni et al. | 505/1 |
| 5,053,074 | 10/1991 | Buljan et al. | 75/236 |

FOREIGN PATENT DOCUMENTS

| | | |
|---|---|---|
| 2-109640 | 4/1990 | Japan . |
| 2-73944 | 6/1990 | Japan . |
| 4-137350 | 5/1992 | Japan . |
| 4-99146 | 7/1992 | Japan . |
| 975505 | 11/1964 | United Kingdom . |
| 1079975 | 8/1967 | United Kingdom . |
| 1109368 | 4/1968 | United Kingdom . |
| 1421422 | 1/1976 | United Kingdom . |

OTHER PUBLICATIONS

Copy of Search Report issued by the U.K. Patent Office dated Jun. 20, 1995.

*Primary Examiner*—Charles T. Jordan
*Assistant Examiner*—Anthony R. Chi
*Attorney, Agent, or Firm*—Finnegan, Henderson, Farabow, Garrett & Dunner, L.L.P.

[57] ABSTRACT

A corrosion-resistant material for the construction of a member destined to contact molten metal comprises a matrix of a refractory metal and a powder of the oxide of at least one metallic element selected from the group consisting of the same metallic element as the molten metal and metallic elements having lower levels of free energy for the formation of an oxide than the molten metal, the powder of the oxide being dispersed and disposed in the matrix. The refractory metal is W, Mo, Ta, Nb, or Re. The metal oxide is selected from the rare earth metal oxides, namely the oxides of the same metallic elements as the molten metals, and the oxides of Ti, Cr, and Zr. The corrosion-resistant material is produced by a method which comprises mixing a refractory metal powder with a powder of the oxide of at least one metallic element selected from the group consisting of the same metallic element as the molten metal and metallic elements having lower levels of free energy for the formation of an oxide than the molten metal and sintering the resultant mixture under a vacuum or in the atmosphere of an inert gas or in a reducing atmosphere.

9 Claims, 3 Drawing Sheets

CORROSION-RESISTANT MATERIAL FOR CONTACT WITH HIGH TEMPERATURE MOLTEN METAL AND METHOD FOR PRODUCTION THEREOF

BACKGROUND OF THE INVENTION

1. Field of the Invention

This invention relates to a corrosion-resistant material excellent in resistance to the corrosion and the thermal impact exerted by molten metal and suitable for use as in crucibles and a method for the production thereof.

2. Description of the Related Art

Rare earth metals such as lanthanum (La), yttrium (Y), neodymium (Nd), and terbium (Tb) are indispensable elements as new alloy materials for permanent magnets, photomagnetic materials, hydrogen absorbing alloys, etc. In recent years, in consequence of the growth of applications found for the alloy materials, the demands for these rare earth metals have been sharply increasing. These rare earth metals have in common the fact that they have lower levels of free energy for the formation of an oxide than the other metallic elements and their oxides are very stable chemically. They occur in the form of oxides in ores, therefore, and are extracted as pure metals from the ores through the processes of smelting and refining. The rare earth metals are used more often in the form of alloys with various metals than they are used as simple metals. During the processes of smelting and refining mentioned above and during the process of alloying as well, these rare earth metals are required to be held for a long time in their molten state in a crucible. Since the rare earth metals in their molten state are extremely active chemically and are liable to react with the material forming the crucible and melt and pass this material into the molten rare earth metals, they are at a disadvantage in inevitably increasing their contents of impurities.

In the materials used for the crucible, ceramic substances generally prove excellent in respect that they do not easily react with a molten rare earth metal. Since the ceramic substance is brittle and liable to be broken by thermal shock or thermal stress, however, the possibility that the molten rare earth metal will flow out of the crucible is high. Further, in the case of a crucible made of a ceramic substance, it often happens that small fragments of the crucible material shed from fine cracks inflicted by thermal stress on the crucible mingle into the molten rare earth metal and add to its content of impurities. As materials, the crucibles made of ceramic substances enjoy excellent corrosion resistance and nevertheless suffer from poor reliability. Though they fit small crucibles of the laboratory grade, they cannot be adapted for large crucibles of the grade of commercial manufacture.

The ceramic coating of the inner wall surface of a crucible made of a metal as by means of plasma spraying is an effective method from the standpoint of repressing the reaction of a molten rare earth metal with the material of the crucible. Not infrequently, the ceramic layer which is brittle by nature sustains a crack owing to the difference in thermal expansion coefficient between the metal forming the crucible and the ceramic forming the coating. Since the ceramic coating layer sustains cracks and exfoliations during one cycle of service of the crucible, the metallic crucible similarly to the ceramic crucible is at a disadvantage in suffering small fragments shed from the ceramic coating to increase the content of impurities in the molten rare earth metal. Thus, the ceramic coating method is not practicable from the viewpoint of cost because the coating layer requires repair each time the crucible is used for melting a rare earth metal.

The refractory metals represented by tungsten (W) and tantalum (Ta) exhibit small degrees of saturated solubility to molten rare earth metals and excel in corrosion resistance besides possessing high melting points. Since these metals are tough as compared with ceramic substances, the possibility that the metallic crucible will sustain breakage from thermal shock or thermal stress and induce leakage of the molten rare earth metal from the crucible is small.

Under the present conditions, therefore, the practice of melting a rare earth metal on a commercial scale by the use of a crucible made of tungsten (W) or tantalum (Ta) is prevalent.

Even in the crucible which is made of tungsten, the fusion of tungsten as the material of the crucible into the molten rare earth metal cannot be thoroughly repressed. Further, in terms of service life, the crucible of tungsten barely tolerates a few cycles of service. From the viewpoint of lowering the cost, the desirability of imparting a long service life to the tungsten crucible has been finding growing recognition.

The present inventors formerly made a study on refractory metallic materials as to their behavior of corrosion in a molten rare earth metal and found that the corrosion occurs in two types of reaction mechanism as illustrated with a model in FIG. 3.

In one reaction mechanism, the corrosion is caused in the boundary between a refractory metal 1 as the material for a crucible and a molten rear earth metal 2 owing to the melting and the diffusion of refractory metal atoms 3 into the molten rare earth metal 2 (corrosion mechanism 1).

In the other reaction mechanism, the corrosion is caused selectively in a grain boundary 4 of the refractory metal 1 by the molten rare earth metal 2, with the result that the crystal grain of the refractory metal 1 will inevitably fall down into the molten rare earth metal 2 (corrosion mechanism 2). This reaction is a phenomenon of the order of crystal grains of the refractory metal 1, namely the order of such a large unit as some tens to some hundreds of μm.

The corrosion reaction due to the corrosion mechanism 1 is a reaction which is necessarily governed by the combination of the refractory metallic material 1 used as the material for the crucible with the rare earth metal material 2 destined to be melted, the melting temperature, and the time. The corrosion of the refractory metal 1 caused by this mechanism, therefore, cannot be abated unless the combination of the materials is altered.

The corrosion reaction due to the corrosion mechanism 2 can be appreciably abated by improving the corrosion resistance of the grain boundary 4 of the refractory metal 1. In fact, the magnitude of the corrosion due to the corrosion mechanism 2 is several times the magnitude of corrosion caused by the corrosion mechanism 1. It has been ascertained, as a result, that the improvement of the corrosion resistance of the grain boundary 4 of the refractory metal 2 has a fair possibility of notably decreasing the amount of the crucible material to be melted into the molten rare earth metal 2 and consequently attaining the elongation of service life of the crucible.

The present inventors have been also ascertained that the infiltration of the molten metal into the grain boundary of the refractory metal can be repressed and the corrosion resistance offered by the refractory metal to the molten metal can be improved by a method which comprises causing ceramic particles to be dispersed in the grain boundary of the refractory metal by means of powder metallurgy (Japanese Patent Laid-Open Application No. Hei-02(1990)-73,944).

After various studies continued thence, it has been found that depending on the combination of the ceramic particles to be dispersed and the rare earth metal to be melted, this method is not fully effective in bringing about the improvement aimed at.

SUMMARY OF THE INVENTION

This invention has been produced for the purpose of solving the problems mentioned above. It has for an object thereof the provision of a highly reliable corrosion-resistant material which exhibits excellent corrosion-resistance to a molten metal, particularly to a chemically active molten rare earth metal, and can be used stably for a long time as the building material of a crucible and a method for the production of the corrosion-resistant material.

The present inventors, after a diligent study, have found that the combination of the ceramic particles to be dispersed in the grain boundary of the refractory metal with the rare earth metal to be melted bears on the corrosion-resistance offered by the refractory metal to the molten metal.

After numerous experiments, they have found that the corrosion-resistance is prominently improved by using as the material for the ceramic particles destined to be dispersed the oxide of the same metallic element as the rare earth metal to be melted or the oxide of a metallic element having a lower level of free energy for the formation of an oxide than the metal to be melted. This invention has resulted from this knowledge.

The corrosion-resistant material of this invention has been perfected on the basis of the knowledge mentioned above. It is characterized in that a material of which a member for contact with molten metal is formed has dispersed in the matrix of a refractory metal either particles of the oxide of the same metallic element as the molten metal or particles of the oxide of a metallic element having a lower level of free energy for the formation of an oxide than the molten metal.

The method of this invention for the production of the corrosion-resistant material is characterized by the steps of mixing a powder of a refractory metal with either a powder of the oxide of the same metallic element as a molten metal or a powder of the oxide of a metallic element having a lower level of free energy for the formation of an oxide than the molten metal and subsequently sintering the resultant mixture under a vacuum or in the atmosphere of an inert gas or in a reducing atmosphere. It is also characterized by further subjecting the sintered mixture to a hot isostatic pressing treatment.

The oxide of a rare earth metal is characterized by unusual thermodynamic stability and substantial inability to react with such refractory metals as tungsten (W) and tantalum (Ta) even at elevated temperatures. Invariably from the oxides of all the rare earth metals, therefore, corrosion-resistant materials can be manufactured by the powder metallurgical process under substantially equal conditions.

As concrete examples of the refractory metal to be used as the matrix of such a refractory building material as a crucible, such refractory metals as tungsten (W), molybdenum (Mo), tantalum (Ta), niobium (Nb), rhenium (Re), and hafnium (Hf) which have melting points exceeding 2000° C. and alloys having these metals as a main component thereof may be cited. Among other concrete examples cited above, tungsten (W) and tantalum (Ta) prove particularly desirable in respect that they excel in stability and corrosion resistance at elevated temperatures.

The molten metal to be used in this invention is at least one member selected from the group consisting of such rare earth metal elements as yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutecium (Lu), titanium (Ti), zirconium (Zr), chromium (Cr), thorium (Th), and uranium (U).

The oxide of a metallic element to be dispersed in the matrix of a refractory metal as the building material for a refractory member in this invention is either the oxide of the same metallic element as the molten metal mentioned above or the oxide of a metallic element having a lower level of free energy for the formation of an oxide than the molten metal.

The rare earth metal elements generally have low levels of free energy for the formation of an oxide as compared with other metallic elements. In the oxides of rare earth metal elements, when $Y_2O_3$, $DY_2O_3$, $Nd_2O_3$, and $Ho_2O_3$ are compared in terms of free energy for the formation of an oxide, they fall in this decreasing order, $Y_2O_3<Ho_2O_3<DY_2O_3<Nd_2O_3$, the $Y_2O_3$ being at the bottom and the $Nd_2O_3$ at the top.

According to this invention, therefore, the powder of $Y_2O_3$ is used where yttrium (Y) is melted and the powder of $Ho_2O_3$ or the powder of $Y_2O_3$, i.e. the oxide of Y having a lower level of free energy for the formation of an oxide than Ho, is used where holmium (Ho) is melted.

The amount of the metal oxide to be contained in the corrosion-resistant material mentioned above is in the range of from 5 to 50 vol. %. If the metal oxide content is less than 5 vol. %, the improvement of the corrosion resistance is not sufficient. Conversely, if this content exceeds 50 vol. %, the toughness of the corrosion-resistant material is impaired so that the corrosion-resistant material is liable to be broken by thermal shock or thermal stress. Preferably, the metal oxide content is in the range of from 5 vol. % to 30 vol. %.

Now, the state in which the corrosion-resistant material of this invention obtained as described above is immersed in a molten metal such as a molten rare earth metal will be described below with reference to a model cross section of FIG. 1. The corrosion-resistant material of this invention, as illustrated in the diagram, has particles 8 of the oxide of the same metallic element as a molten metal 7 dispersed as disposed along boundaries 6 of grains of a refractory metal 5.

Where a particle 8 of the metal oxide is exposed from the surface as in an area A of FIG. 1, the grain boundary 6 of the refractory metal 5 will never directly contact the molten metal 7. Further, since such a metal oxide as the rare earth metal oxide generally is not liable to be wetted with a molten mass of the same metal, the molten metal 7 will never penetrate the boundary between the particle 8 and the refractory metal 5.

Where no particle 8 of the metal oxide is exposed from the surface as in the boundary of an area B, the grain boundary 6 of the refractory metal 5 is selectively corroded by the molten metal 7 as described above. This corrosion stops at the time that the penetrating molten metal 7 reaches the particle 8 of the metal oxide on the inner side. It will never be allowed to advance to a point where the grain of the refractory metal 5 falls down.

Owing to the effect of dispersion of the particles 8 of metal oxide as described above, the corrosion of the refractory metal 5 due to the corrosion mechanism 2 of a large corrosion velocity is curbed substantially completely. The corrosion of the refractory metal 5 by the molten metal 7 has the velocity thereof conspicuously abated because this corrosion is limited to the reaction between the grains of the refractory metal 5 themselves and the molten metal 7, namely to the reaction due to the corrosion mechanism 1, as in the area C.

The corrosion-resistant material of this invention which is constructed as described above is obtained by mixing a powder of a refractory metal with a powder of the oxide of the same metallic element as the metal to be melted or with a powder of the oxide of a metallic element having a lower level of free energy for the formation of an oxide than the metal to be melted and subsequently sintering the resultant mixture under a vacuum or in the atmosphere of an inert gas or in a reducing atmosphere such as hydrogen gas. The refractory metal is metallurgically joined to itself along substantially all the grain boundaries of the refractory metal. The corrosion-resistant material of this invention, therefore, is not so deficient in toughness as ceramic substances but excellent in resistance to thermal shock and to thermal stress. In this invention, when the corrosion-resistant material obtained at the end of the sintering treatment is further subjected to a hot isostatic pressing (HIP) treatment, the binding force exerted between the grains of the refractory metal and the particles of the oxide can be exalted.

Further, in this invention, since the ceramic particles (particles of metal oxide) dispersed as disposed along the grain boundaries of the refractory metal obstruct the growth of grains owing to the recrystallization of metal, the grains of the refractory metal are very minute as compared with those of pure metal and the strength of the material at normal temperature and at elevated temperatures is conspicuously improved. For this reason, even when the corrosion-resistant material is exposed for a long time to an elevated temperature exceeding 1500° C. as when a rare earth element is melted, the grains thereof will never be coarsened or embrittled. Thus, this invention is highly effective in elongating the service life of a crucible.

DESCRIPTION OF THE PREFERRED EMBODIMENTS

Now, a preferred embodiment of this invention will be described below with reference to FIG. 2A, FIG. 2B, FIG. 2C, FIG. 2D, and FIG. 2E.

Figure 1:
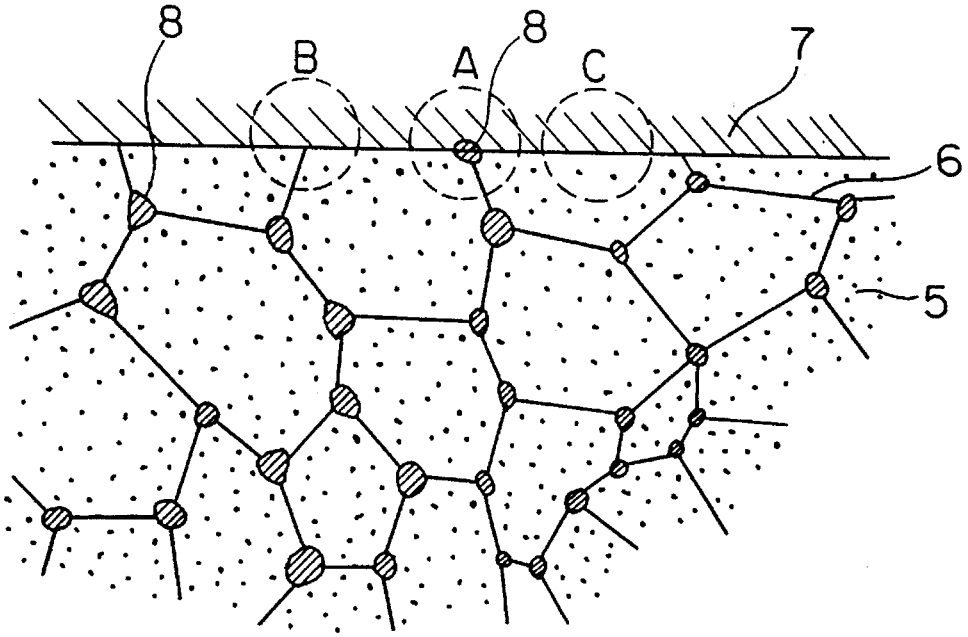
FIG. 1 is a diagram illustrating with a model the state in which a corrosion-resistant material of this invention is immersed in molten metal.
Figure 3:
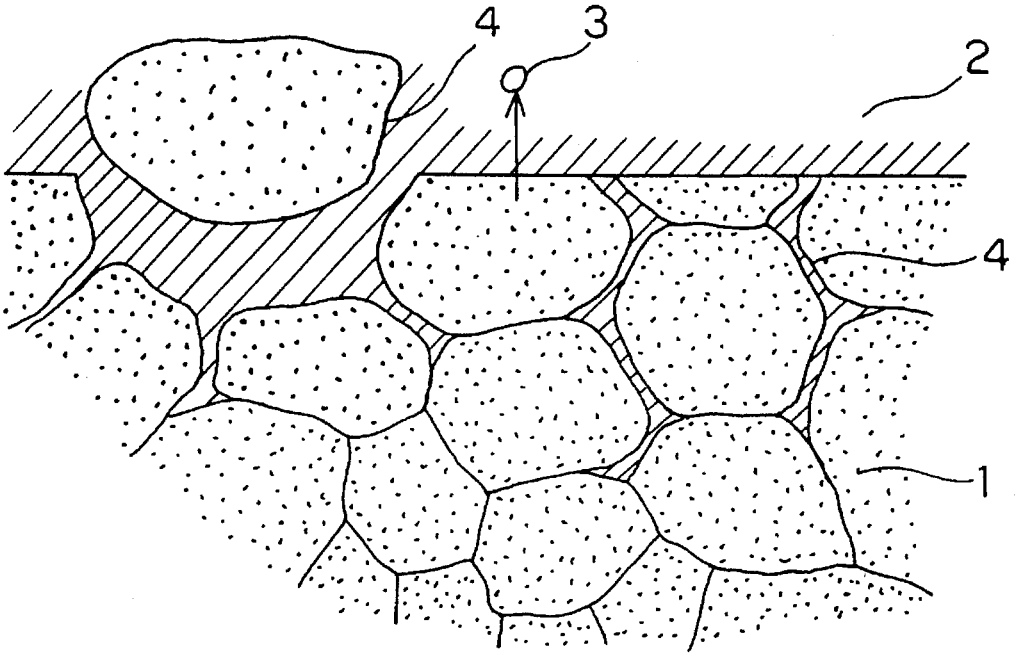
FIG. 3 is a diagram illustrating with a model the corrosion mechanism in process in a refractory metal in the molten metal.
Figure 2A:
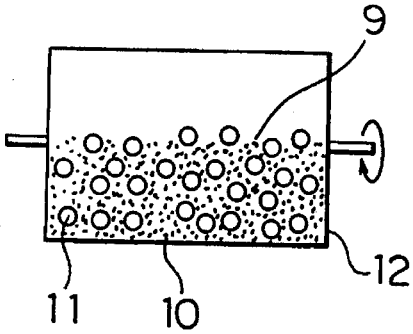
FIG. 2A, FIG. 2B, FIG. 2C, FIG. 2D, and FIG. 2E are explanatory diagrams illustrating a series of steps for the manufacture of the corrosion-resistant material of this invention.

As illustrated in FIG. 2A, a powder 9 of such a refractory metal as tungsten and a powder 10 of a rare earth metal oxide are placed in amounts forming a prescribed ratio together with ceramic balls 11 in a mixer 12 and the mixer 12 is set to rotating. The impact of the collision of individual ceramic balls 11 in consequence of their free motion of gravitational fall pulverizes the powder 10 of the brittle rare earth metal oxide and causes the pulverized powder 10 to be uniformly dispersed in the powder 9 of the refractory metal. From the viewpoint of dispersibility, the powder 10 of the rare earth metal oxide is desired to have as small a particle diameter as permissible. Specifically, the pulverization is desired to proceed to an extent of decreasing the average particle diameter of the oxide powder to below 0.1 μm. The mixing ratio of the powder 9 of the refractory metal and the powder 10 of the rare earth metal oxide is desired to be such that the rare earth metal oxide particles may be dispersed and disposed at all the triple points of the grain boundaries of the refractory metal after the sintering, providing that the term "triple point" means the point at which three grains simultaneously contact as shown in FIG. 1. The mixing ratio, therefore, is variable with the size of the grains of the refractory metal and the size of the rare earth metal oxide particles. Desirably, it is so fixed that the content of the rare earth metal oxide powder 10 may account for a proportion in the range of from 5 to 50 vol. %, preferably from 5 to 30 vol. %, to the total volume of the produced mixture. If the content of the rare earth metal oxide powder 10 exceeds 50 vol. % of the whole volume of the mixture, the produced corrosion-resistant will be at a disadvantage in acquiring unduly low toughness.

Figure 2B:
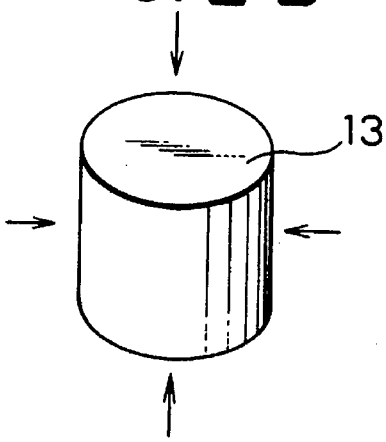

Then, the mixed powder consisting of the powder 9 of the refractory metal with the rare earth metal oxide powder 10 is packed in a rubber vessel and hydrostatically pressed under about 2000 atmospheres to obtain a compression molded article 13 as illustrated in FIG. 2B. In this case, the relative density of the mixed powder can be heightened from the initial level of about 30% to a final level of about 60% in consequence of the hydrostatic pressure mentioned above.

Figure 2C:
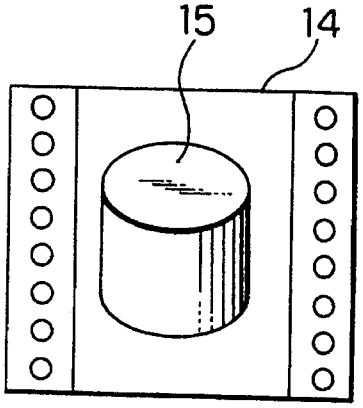

Now, the produced compression molded article 13 is placed in an electric furnace 14 as illustrated in FIG. 2C and sintered therein under a vacuum or in the atmosphere of an inert gas or in a reducing atmosphere such as of hydrogen gas at a temperature in the approximate range of from 1600° C. to 2000° C. As a result, a sintered article 15 having a relative density of from 90 to 99% is obtained.

Figure 2D:
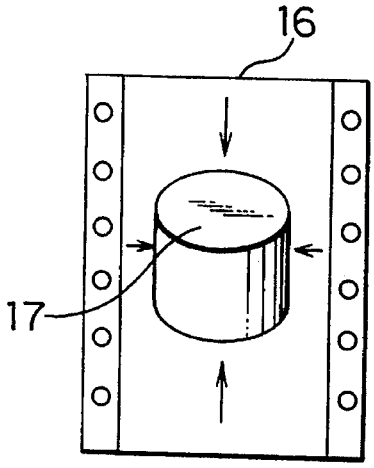
Figure 2E:
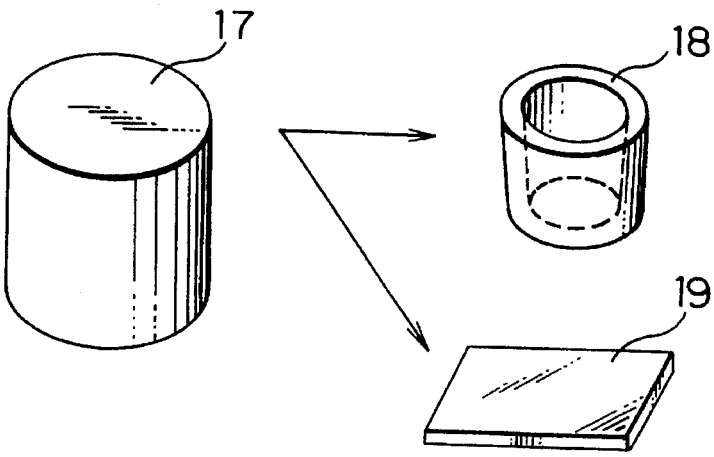

Further, for the purpose of expelling residual pores from the interior of the sintered article 15 and heightening the binding force between the grains of the sintered article 15, the sintered article 15 is placed in a hot isostatic pressing device 16 as illustrated in FIG. 2D and subjected to pressure sintering therein at a temperature of more than 1000° C., and under a pressure of more than 1000 atmospheres (gas pressure). As a result, a pressure sintered article 17 compacted to substantially true density is obtained.

When the produced pressure sintered article 17 is further machined, such a corrosion-resistant refractory member as a crucible 18 is obtained. The pressure sintered article 17, when necessary, may be subjected to such plastic working as hot forging or hot rolling to produce a platelike member or a barlike member 19 [FIG. 2E]. Otherwise, by making the most of the characteristics of powder metallurgy, the pressure sintered article 17 may be directly turned into a finished product without undergoing any appreciable cutting work or rolling work.

Now, concrete examples of the corrosion-resistant material of this invention will be described below.

EXAMPLE 1

Corrosion-resistant materials 1 through 7 were obtained by preparing mixed powders using tungsten (W) as a high melting matrix metal and $Y_2O_3$, $DY_2O_3$, $Nd_2O_3$, and $Ho_2O_3$ respectively as rare earth metal oxides in amounts calculated to give compositions shown in Table 1, shaping the mixed powders, and sintering the shaped masses.

Comparative Example

For the purpose of comparison, a sample formed solely of tungsten (W) powder and containing no rare earth metal oxide was similarly pressed hydrostatically to form a shaped article, sintered, and further subjected to a hot isostatic pressing treatment to obtain a sample for comparison.

Figure 4:
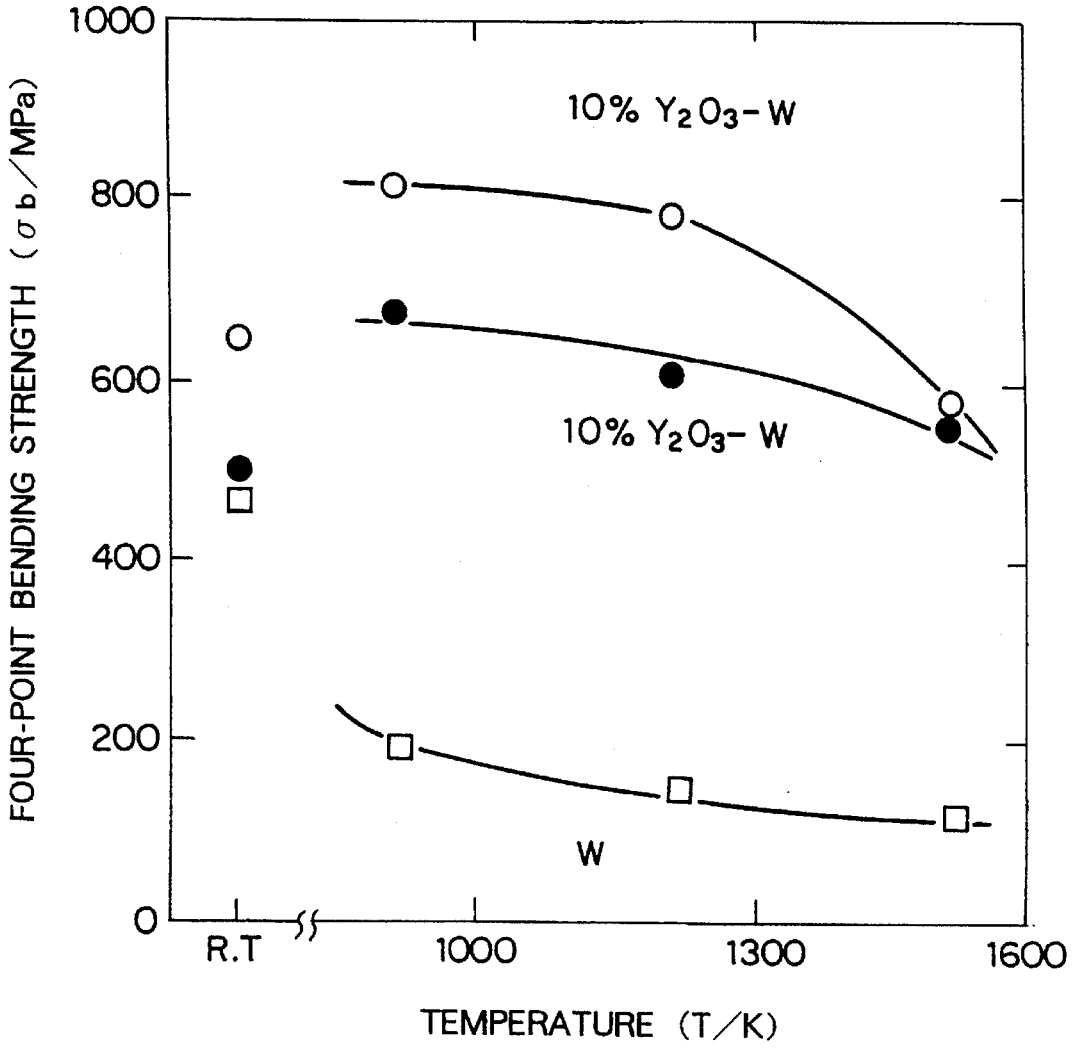
FIG. 4 is a diagram illustrating bending strengths exhibited by the corrosion-resistant material of this invention and a sample for comparison at normal room temperature and at elevated temperatures.

The texture of a sintered article of W as a corrosion-resistant material 3 containing 20 vol. % of $Y_2O_3$ and the texture of the sample solely of W for comparison were observed under a microscope. As a result, the texture of the sintered article of W containing 20 vol. % of $Y_2O_3$ was found to have minute $Y_2O_3$ particles uniformly dispersed along the grain boundaries of tungsten. The grains of tungsten had an average particle diameter of 5 μm and those of the sample solely of W had an average particle diameter of 200 μm, indicating that the former grains were about 1/20 of the latter grains. It was also found that the strength of sintered article was increased in proportion as the size of grains decreased. Incidentally, the strength of a metallic material is theoretically proportional to $1/(\text{grain size})^{1/2}$. The strength, therefore, increases in proportion as the grain size decreases. The corrosion-resistant material 2 obtained in this example and the sample for comparison were tested for four-point bending strength at normal room temperature and elevated temperatures. The results are shown in FIG. 4. It is clearly noted from FIG. 4 that the corrosion-resistant material of this invention had the strength thereof prominently improved at elevated temperatures. In FIG. 4, ○ represents an HIP treated sample formed of 10 vol. % $Y_2O_3$ and W, ● for a sample of 10 vol. % $Y_2O_3$ and W sintered under normal pressure and given no HIP treatment, and □ for an HIP treated sample formed solely of W.

Then, these samples were severally left immersed for one hour in molten rare earth metals of Y, Dy, Nd, and Ho shown in Table 1 at 1650° C.and, at the end of the immersion, were visually examined to rate the state of corrosion of texture. The results of the rating are shown in Table 1.

EXAMPLE 2

Corrosion-resistant materials 8 through 10 were obtained by preparing mixed powders using tungsten (W) as a high melting matric metal and $TiO_2$, $Cr_2O_3$, and $ZrO_2$ respectively as rare earth metal oxides in amounts calculated to give compositions shown in Table 1, shaping the mixed powders, and sintering the shaped masses. In this case, the corrosion-resistant materials were severally kept immersed in molten Ti, Cr, and Zr for one hour and, after the immersion, visually examined to rate the state of corrosion of texture. The results are shown in Table 1.

TABLE 1

| Corrosion-resistant material | | | | Molten metal | | | | | | |
|---|---|---|---|---|---|---|---|---|---|---|
| No. | Metal oxide | Content (Vol. %) | Refractory metal | Y | Dy | Nd | Ho | Ti | Cr | Zr |
| 1 | $Y_2O_3$ | 5 | W | Δ | Δ | x | ○ | — | — | — |
| 2 | $Y_2O_3$ | 10 | W | ○ | Δ | x | ○ | — | — | — |
| 3 | $Y_2O_3$ | 20 | W | ⊙ | ○ | Δ | ○ | ○ | ○ | ○ |

TABLE 1-continued

| Corrosion-resistant material | | | | Molten metal | | | | | | |
|---|---|---|---|---|---|---|---|---|---|---|
| No. | Metal oxide | Content (Vol. %) | Refractory metal | Y | Dy | Nd | Ho | Ti | Cr | Zr |
| 4 | $Y_2O_3$ | 30 | W | ⊙ | ○ | ○ | ○ | — | — | — |
| 5 | $Dy_2O_3$ | 10 | W | ○ | ⊙ | Δ | ○ | — | — | — |
| 6 | $Nd_2O_3$ | 20 | W | ○ | Δ | ⊙ | Δ | ○ | ○ | ○ |
| 7 | $Ho_2O_3$ | 30 | W | ○ | ○ | Δ | ⊙ | — | — | — |
| 8 | $TiO_2$ | 20 | W | x | — | — | — | ⊙ | ○ | x |
| 9 | $Cr_2O_3$ | 20 | W | x | — | — | — | x | ⊙ | x |
| 10 | $ZrO_2$ | 20 | W | x | — | — | — | Δ | ○ | ⊙ |
| Comparative Example 1 | | | W | x | x | x | Δ | — | — | — |

Note:
⊙ stands for substantial absence of discernible corrosion,
○ for presence of slight corrosion,
Δ for presence of fairly clear sign of corrosion,
x for presence of conspicuous corrosion, and
— for omission of test.

From the results of Table 1, it is noted that when particles of $Y_2O_3$, $Dy_2O_3$, $Nd_2O_3$, and $Ho_2O_3$, i.e. rare earth metal oxides, were dispersed along grain boundaries of tungsten, the produced alloy exhibited improved corrosion resistance to a molten rare earth metal as compared with pure tungsten and that this effect gained in prominence in accordance as the content of rare earth metal oxide increased.

A tungsten alloy containing 20 vol. % of $Y_2O_3$, for example, exhibited veritably outstanding corrosion resistance to molten yttrium (Y) and fairly high corrosion resistance to molten dysprosium (Dy) and holmium (Ho) but showed a sign of appreciable corrosion to molten neodymium (Nd).

A tungsten alloy containing 20 vol. % of $Nd_2O_3$ showed a sign of considerable corrosion to molten dysprosium (Dy) and holmium (Ho) and nevertheless exhibited very high corrosion resistance to molten neodymium (Nd).

Thus, it has been ascertained that tungsten alloys having dispersed therein particles of the oxide of the same metallic element as a rare earth metal element to be melted as in the combination of molten metal Y with a metal oxide $Y_2O_3$, molten metal Dy with a metal oxide $Dy_2O_3$, molten metal Nd with a metal oxide $Nd_2O_3$, and molten metal Ho with a metal oxide $Ho_2O_3$ enjoy conspicuously improved corrosion resistance to the molten rare earth metal.

These compounds, $Y_2O_3$, $Dy_2O_3$, $Nd_2O_3$, and $Ho_2O_3$, are the oxides of metallic elements which have low levels of free energy for the formation of an oxide and they fall in this decreasing order, $Y_2O_3<Ho_2O_3<Dy_2O_3<Nd_2O_3$. The results of Table 1 demonstrate that the tungsten alloy having dispersed therein particles of $Y_2O_3$, the oxide of yttrium (Y) having the lowest level of free energy for the formation of an oxide in all the metallic elements mentioned above, in a concentration of 30 vol. %, for example, manifests an effective improvement in the corrosion resistance even to molten dysprosium (Dy), neodymium (Nd), and holmium (Ho).

When Ti, Cr, and Zr were used as molten metals, corrosion-resistant materials having particles of the oxides of respective metallic elements dispersed in the matrix of W showed no sign of corrosion to the molten metals. The tungsten alloys having dispersed in the W matrix thereof particles of the oxides of rare earth metals having low levels of free energy for the formation of an oxide succumbed to corrosion only slightly.

The alloy using $Cr_2O_3$, which has the highest level of free energy for the formation of an oxide in all the oxides, $TiO_2$, $Cr_2O_3$, and $ZrO_2$, showed a sign of conspicuous corrosion in molten Ti and Zr.

It is clearly noted from the description given above that the corrosion-resistant material of this invention exhibits excellent corrosion resistance to a molten metal, particularly to a molten rare earth metal having high chemical activity and, therefore, can be used stably for a long time as the building material such as of a crucible. When the crucible made of this corrosion-resistant material is used for melting the ore of a rare earth metal, the rare earth metal of high purity can be provided at a low cost.

Further, by the method of this invention, the corrosion-resistant material of high reliability as described above can be manufactured.

What is claimed is:

1. A corrosion resistant material comprising:

a refractory metal matrix having grains separated by grain boundaries; and molten metal wetting prevention means for preventing the infiltration of a molten, preselected metal into the grain boundaries by presenting a non-wetting surface to the molten metal;

the molten metal wetting prevention means being oxides of metal elements selected from the group consisting of the preselected metal and metals having lower free energies for the formation of the oxide than the preselected metal.

2. The corrosion-resistant material according to claim 1, wherein the oxides are oxides of the preselected metal.

3. The corrosion-resistant material according to claim 1, wherein said refractory metal is at least one member selected from the group consisting of W, Mo, Ta, Nb, Re, and alloys having said metals as a main component thereof.

4. The corrosion-resistant material according to claim 1, wherein said molten, preselected metal is at least one metallic element selected from the group consisting of Y, La, Ce, Pr, Nd, Pm, Sm, Eu, Gd, Tb, Dy, Ho, Er, Tm, Yb, Lu, Ti, Cr, Zr, Th and U.

5. The corrosion-resistant material according to claim 1, wherein the content of the oxides is in the range of from 5 to 50 vol. %, based on the volume of said corrosion-resistant material.

6. The corrosion-resistant material according to claim 4, wherein the content of the oxides is in the range of from 5 to 30 vol. %, based on the volume of said corrosion-resistant material.

7. The corrosion-resistant material according to claim 1, wherein said oxides are dispersed in and disposed along the grain boundaries of said refractory metal.

8. The corrosion-resistant material according to claim 1, wherein said corrosion-resistant material is in the form of a sintered article.

9. The corrosion-resistant material according to claim 8, wherein said sintered article has a relative density of at least 90%.

* * * * *